US006095517A

United States Patent [19]

Dinatale

[11] Patent Number: 6,095,517

[45] Date of Patent: Aug. 1, 2000

[54] 1-N AND N-1 CUT SHEET RECEIVING AND STACKING APPARATUS

[75] Inventor: Ernest L. Dinatale, Rochester, N.Y.

[73] Assignee: Xerox Corporation, Stamford, Conn.

[21] Appl. No.: 09/165,553

[22] Filed: Oct. 2, 1998

[51] Int. Cl.[7] ..... B65H 31/08

[52] U.S. Cl. ..... 271/212; 271/213; 271/292

[58] Field of Search ..... 271/212, 213, 271/292

[56] References Cited

U.S. PATENT DOCUMENTS

| | | | |
|---|---|---|---|
| 4,067,568 | 1/1978 | Irvine | 271/212 X |
| 4,220,323 | 9/1980 | Smith | 271/65 |
| 4,371,276 | 2/1983 | Mitrovich et al. | 400/625 |
| 4,384,782 | 5/1983 | Acquaviva | 271/212 X |
| 4,413,901 | 11/1983 | Kollar | 271/212 X |
| 4,858,909 | 8/1989 | Stemmle | 271/184 |
| 5,022,640 | 6/1991 | Greco, Jr. | 271/31 |
| 5,078,383 | 1/1992 | Shiina et al. | 271/212 |
| 5,123,639 | 6/1992 | Edwards | 271/212 |
| 5,147,092 | 9/1992 | Driscoll et al. | 271/212 X |
| 5,244,200 | 9/1993 | Manzke | 271/212 X |

FOREIGN PATENT DOCUMENTS

| | | | |
|---|---|---|---|
| 235248 | 9/1988 | Japan | 271/212 |
| 41369 | 2/1992 | Japan | 271/212 |
| 140280 | 5/1992 | Japan | 271/212 |
| 173651 | 6/1992 | Japan | 271/212 |

*Primary Examiner*—Christopher P. Ellis
*Assistant Examiner*—Richard Ridley
*Attorney, Agent, or Firm*—Tallam I. Nguti

[57] ABSTRACT

A 1-N and N-1 cut sheet receiving and stacking apparatus for receiving and selectively stacking sheets to a top location, as well as to a bottom location on a stack of such sheets. The sheet receiving and stacking apparatus comprises a frame, a sheet supporting member mounted to the frame for receiving and supporting a stack of cut sheets. Importantly, the cut sheet receiving and stacking apparatus includes at least one cut sheet lifting and locating assembly mounted to the frame for locating a cut sheet being received to a top location of the stack, and for lifting the stack and locating a cut sheet being received to a bottom location of the stack. The cut sheet lifting and locating assembly has a first down position for locating a cut sheet being received to the top location of the stack of cut sheets, and at least a first up position for lifting the stack of cut sheets thereon and locating a cut sheet being received to the bottom location of the stack.

7 Claims, 5 Drawing Sheets

FIG. 3A
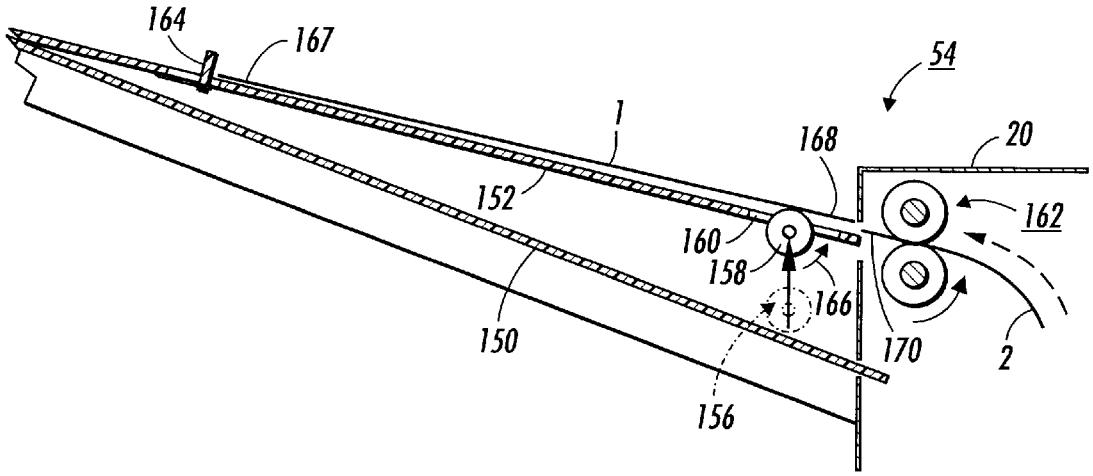
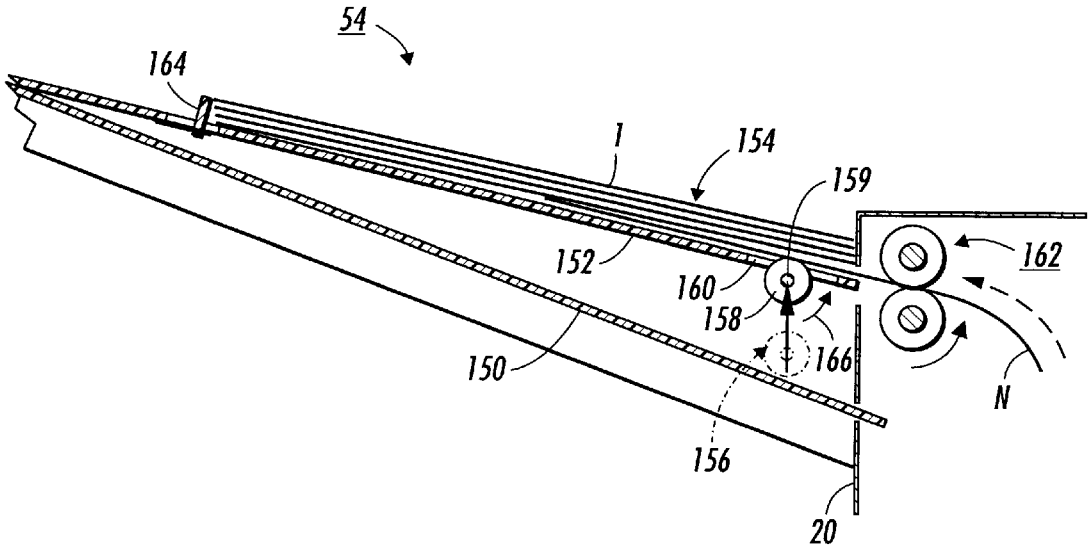
FIG. 3B

FIG. 5A
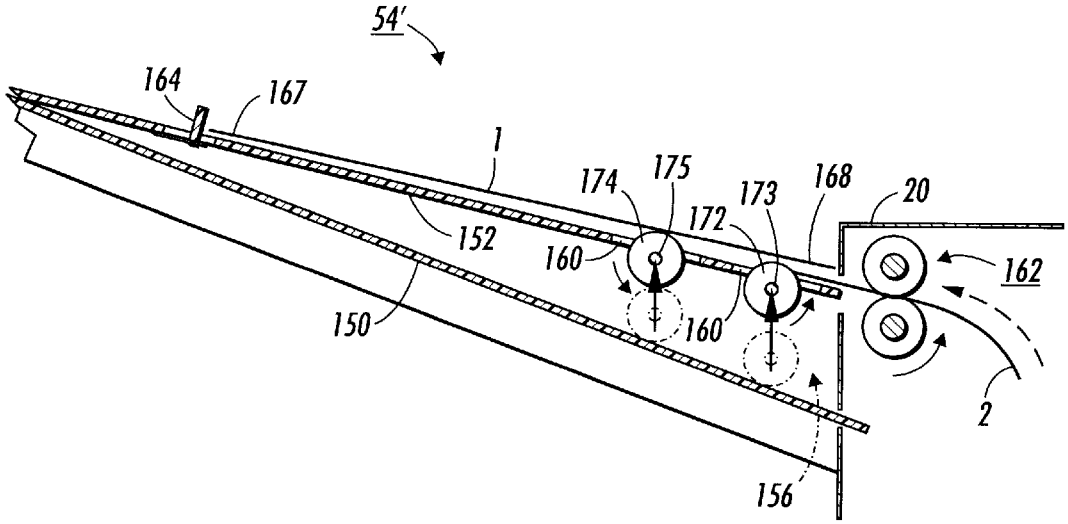
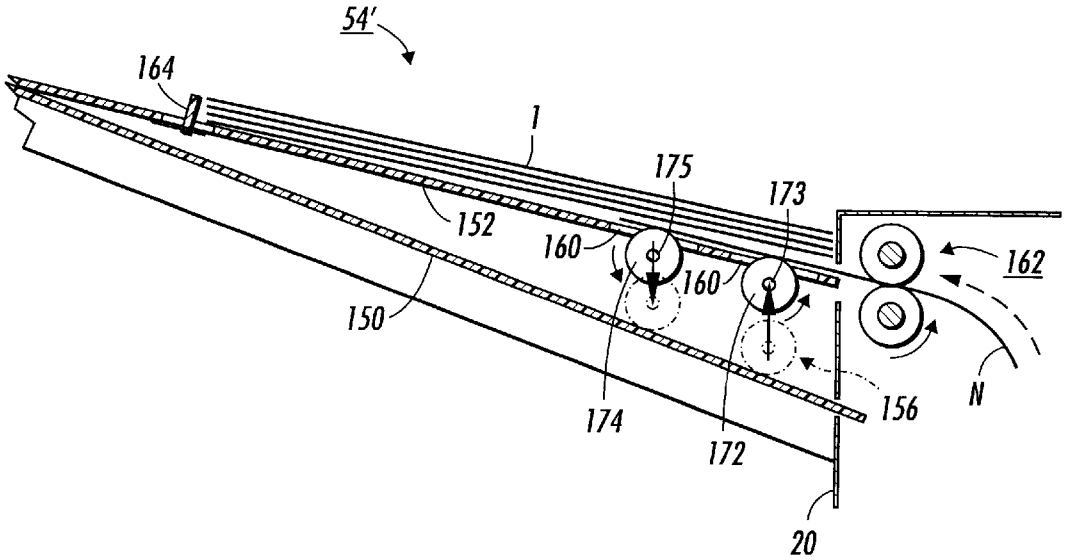
FIG. 5B

1-N AND N-1 CUT SHEET RECEIVING AND STACKING APPARATUS

BACKGROUND

This invention relates to electrostatographic reproduction machines, and more particularly to electrostatographic reproduction machine including a simple low cost 1-N and N-1 cut output sheet receiving and stacking apparatus.

Generally, the process of electrostatographic reproduction includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler (ADH), on a platen for such exposure. A set of 1-N such original documents can thus be fed seriatim by an ADH for such registration and platen exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" or finished copy of the original image. The finished copy of each original document is then fed to an output tray for subsequent removal and use by an operator.

One of the challenges encountered in the handling of finished copies, particularly a set of 1-N finished copies made from a set of 1-N original documents handled by an ADH, is how to logically receive and stack the output set. There are of course situations in which it is desirable to stack such an output set 1-N, and other situations in which the desired stacking sequence is N-1.

Conventionally, many attempts have been made to meet this challenge. For example, U.S. Pat. No. 4,220,323 issued Sep. 2, 1980, discloses a sheet receiving and stacking apparatus having a guide member and two sheet supporting surfaces for receiving and stacking cut sheets in a first orientation or in an inverted orientation. The guide member has a first position for directing sheets in the first orientation onto a first supporting surface, and a second position where it forms the second surface for receiving and stacking the sheets in the inverted orientation.

U.S. Pat. No. 4,384,782 issued May 24, 1983, discloses a reproduction machine including a 1-N order document copying sheet handling apparatus. The sheet handling apparatus is adapted for selectively feeding document sheets from one end of a top of a stack of such sheets, in a forward direction for copying, and restacking the copied sheets at the bottom of the opposite end of the same stack in the same order. The sheet handling apparatus includes an intermittent lifting device that combines with a vacuum belt for lifting the opposite end, a vacuum belt transport, and an air flotation device.

There is therefore still a need in an electrostatographic reproduction machine for a simple and less costly apparatus for receiving and stacking cut output sheets in 1-N and N-1 sequence.

SUMMARY OF THE INVENTION

In accordance with the present invention, there is provided a 1-N and N-1 cut sheet receiving and stacking apparatus for receiving and selectively stacking sheets to a top location, as well as to a bottom location on a stack of such sheets. The sheet receiving and stacking apparatus comprises a frame, a sheet supporting member mounted to the frame for receiving and supporting a stack of cut sheets. Importantly, the cut sheet receiving and stacking apparatus includes at least one cut sheet lifting and locating assembly mounted to the frame for locating a cut sheet being received to a top location of the stack, and for lifting the stack and locating a cut sheet being received to a bottom location of the stack. The cut sheet lifting and locating assembly has a first down position for locating a cut sheet being received to the top location of the stack of cut sheets, and at least a first up position for lifting the stack of cut sheets thereon and locating a cut sheet being received to the bottom location of the stack.

BRIEF DESCRIPTION OF THE DRAWINGS

In the detailed description of the invention presented below, reference is made to the drawings, in which:

FIGS. 3A and 3B are each a schematic illustration of the first embodiment apparatus of FIG. 2 set for receiving and bottom stacking such sheets to be in an N-1, bottom to top, sequence;

FIGS. 5A and 5B are each a schematic illustration of the second embodiment apparatus of FIG. 4 set for receiving and bottom stacking such sheets to be in an N-1, bottom to top, sequence.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
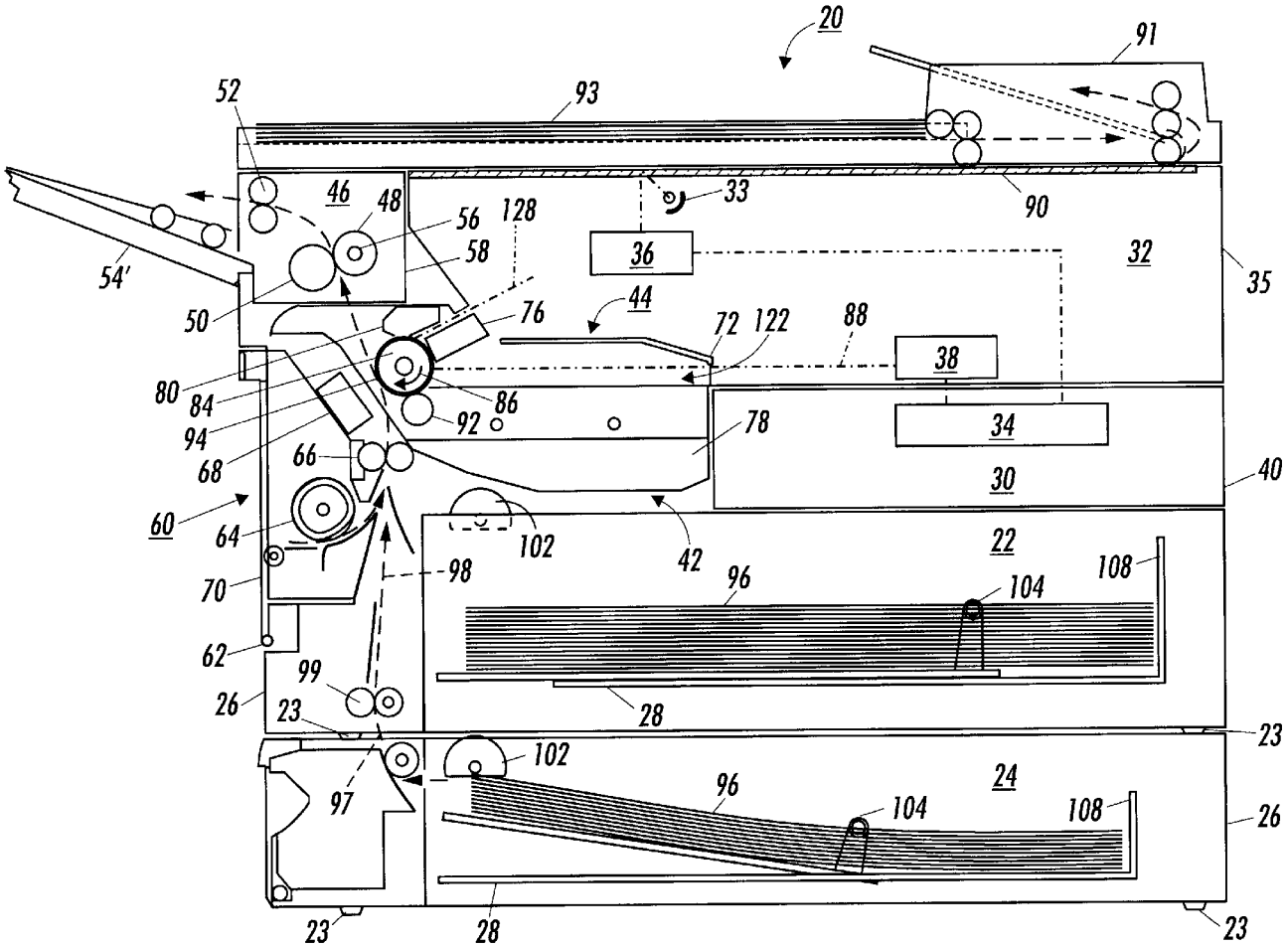
FIG. 1 is a vertical schematic of an exemplary electrostatographic reproduction machine including the 1-N and N-1 cut sheet receiving and stacking apparatus in accordance with the present invention.

Referring now to FIG. 1, there is illustrated an exemplary electrostatographic reproduction machine 20 comprising separately framed mutually aligning modules, including the 1-N and N-1 cut sheet receiving and stacking apparatus 54 according to the present invention. The machine 20 is comprised of a number of individually framed, and mutually aligning machine modules that variously include pre-aligned electrostatographic active process subsystems.

As shown, the machine 20 comprises at least a framed copy sheet input module (CIM) 22. Preferably, the machine 20 comprises a pair of such copy sheet input modules, a main or primary module the CIM 22, and an auxiliary module the (ACIM) 24, each of which has a set of legs 23 that can support the machine 20 on a surface, therefore suitably enabling each CIM 22, 24 to form a base of the machine 20. As also shown, each copy sheet input module (CIM, ACIM) includes a module frame or housing 26 with external covers, and a copy sheet stacking and lifting cassette tray assembly 28 that is slidably movable in and out relative to the module frame 26, in order to enable its reloading with sheets of the paper. When as preferred here, the machine 20 includes two copy sheet input modules, the very base module is considered the auxiliary module (the ACIM), and the top module which mounts and mutually aligns against the base module is considered the primary module (the CIM).

Generally, the sheet stacking and lifting cassette tray assembly 28 includes a D-shaped feedhead roller 102, and an adjustable sheet dimension guide member 104 for holding a stack of sheets 96 in alignment. As pointed out above, the module frame 26 includes an external or outer cover 27, and thus serves as a covered base portion of the machine 20. As further shown, the ACIM 24 further comprises sheet path extension portion 97 to a sheet path 98, that includes sheet advancing rollers 99 for advancing sheets fed from the ACIM 24 to a common set of registration rollers 66. The registration rollers then supply registered sheets 96 from the CIM 22 and ACIM 24 to an image transfer point 94 on a photoreceptor or drum 84.

The main and auxiliary copy input sheet modules 22, 24 and the associated paper path extension 97 advantageously allows a "load-while-running" ability, meaning that an operator is able to load paper into one of them, while a job is running with paper being fed out of the other. The D-shaped forward buckle feedhead roller 102 of each copy input module is energized via a solenoid (not shown) that is activated by a single revolution clutch (not shown), and is driven by a drives module (not shown) of the machine 20. Each revolution of the D-shaped feedhead roller 102 corresponds to one sheet of paper being fed.

The machine 20 next comprises a framed electronic control and power supply (ECS/PS) module 30. As shown, the ECS/PS module mounts onto, and is mutually aligned against the CIM 22 (which preferably is the top or only copy sheet input module). The ECS/PS module 30 includes all controls and power supplies for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. Importantly, the ECS/PS module 30 includes a module frame 40 to which the active components of the module as above are mounted, and which forms a covered portion of the machine 20, as well as locates, mutually aligns, and mounts to adjacent framed modules, such as the CIM 22 and the imager module 32.

The machine 20 also comprises the separately framed imager module 32, which mounts over, and mutually aligns against the ECS/PS module 30. As shown, the RIS 36, the ROS 38, a light source 33, and an imager module frame 35 comprise the imager module 32. The RIS 36 preferably is a full rate/half rate scanner with imaging optics and a CCD array (not shown separately), for converting hard copy images to electronic bit maps or digitized images. The imager module 32 includes electrical connection means (not shown) connecting the RIS 36 to an image processing unit (IPP) 34 for processing the digitized images. The imager module 32 has a platen 90 and an automatic document handler 91 that holds a set 93 of original documents for recirculation and exposure on the platen 90.

The framed copy sheet input modules 22, 24, the ECS/PS module 30, and the imager module 32, as mounted above, define a cavity 42. The machine 20 importantly includes a customer replaceable, all-in-one CRU or process cartridge module 44 that is insertably and removably mounted within the cavity 42, and in which it is mutually aligned with, and operatively connected to, the framed CIM, ECS/PS and imager modules 22, 30, 32. The CRU or process cartridge module 44 generally comprises a module housing subassembly 72, a photoreceptor 84 rotatable in the direction of the arrow 86, a charging subassembly 76, a developer subassembly 78 including a developer roll 92, a cleaning subassembly 80 for removing residual toner as waste toner from a surface of the photoreceptor, and a waste toner sump subassembly 82 (FIG. 2) for storing waste toner. The module housing subassembly 72 of the CRU or process cartridge module 44 importantly includes a first path 122 for receiving a ROS beam 88 onto the photoreceptor 84, and a second path for receiving an erase light 128 onto the photoreceptor.

As further shown, the machine 20 includes a framed fuser module 46, that is mounted above the process cartridge module 44, as well as adjacent an end of the imager module 32. The fuser module 46 comprises a pair of fuser rolls 48, 50, and at least an exit roll 52 for moving an image carrying sheet through, and out of, the fuser module 46. The fuser module also includes a heater lamp 56, temperature sensing means (not shown), paper path handling baffles (not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine 20 then includes an active component framed door module 60, which is mounted pivotably at pivot point 62 to an end of the CIM 22. The door module 60 as mounted, is pivotable from a substantially closed vertical position into an open near-horizontal position in order to provide access to the process cartridge module 44, as well as for jam clearance of jammed sheets being fed from the CIM 22. The Door module 60 comprises active components including a bypass feeder assembly 64, sheet registration rolls 66, toner image transfer and detack devices 68, and the 1-N and N-1 cut sheet receiving and stacking apparatus 54, 54' of the present invention (to be described in detail below).

The door module 60 also includes drive coupling components and electrical connectors (not shown), and importantly, a module frame 70 to which the active components of the module as above are mounted, and which forms a covered portion of the machine 20, as well as, locates, mutually aligns, and mounts to adjacent framed modules, such as the CIM 22, the process cartridge module 44, and the fuser module 46. The door module 60 is mounted pivotably to the CIM 22 at a pivot 62, such that it is openable for providing access to a portion of the copy paper path 98 (jam clearance) and to the process cartridge module 44 (cartridge removal and replacement).

Although a particular modular type electrostatographic reproduction has been described herein for producing hard-copies of original documents for subsequent receiving and stacking by the apparatus 54, 54' of the present invention, it will be understood that the present invention is equally usable with any other type of copy reproduction machine.

Figure 2:
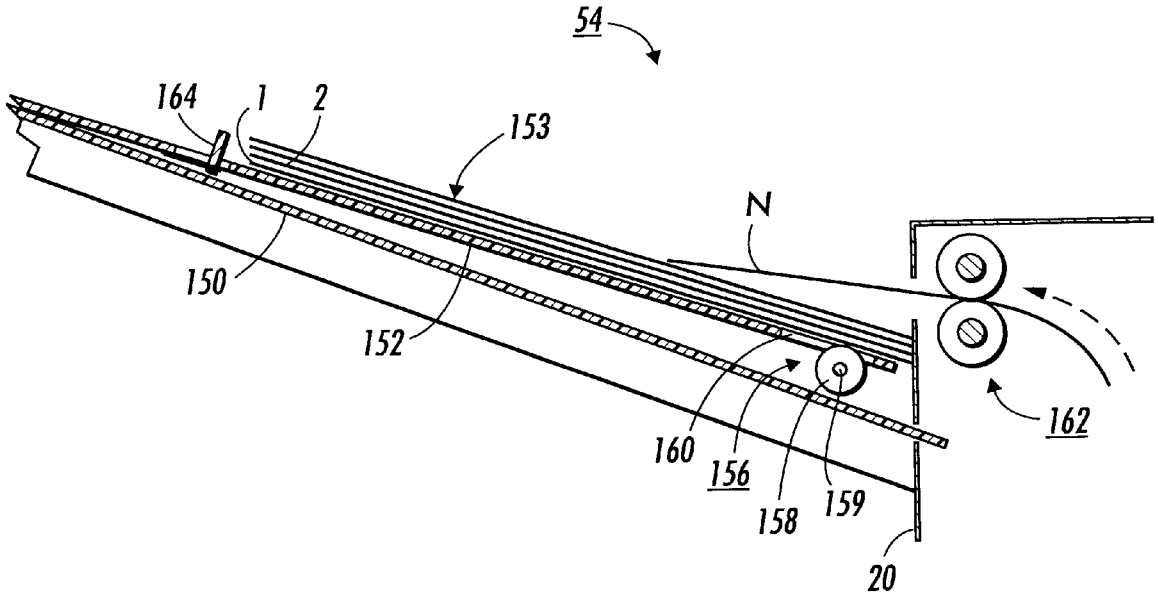
FIG. 2 is a schematic illustration of a first embodiment of the 1-N and N-1 cut sheet receiving and stacking apparatus in accordance with the present invention set for receiving top stacking sheets to be in a 1-N, bottom to top, sequence.

Referring now to FIGS. 2, 3A and 3B, a first embodiment of the 1-N and N-1 cut sheet receiving and stacking apparatus 54 is illustrated. As shown, this embodiment includes a frame 150 mounted to a frame of the machine 20, and a sheet supporting member 152 mounted pivotably (pivot point not shown) to the frame 150 for supporting a stack 154 of cut sheets in a desired 1-N (bottom-to-top) sequence (FIG. 2), or in an N-1 (bottom-to-top) sequence (FIGS. 3A and 3B).

Importantly, the first embodiment 54 of the apparatus 54, 54' of the present invention includes a cut sheet lifting and locating assembly, shown generally as 156, for example, a set of movable rolls 158 on a shaft 159, that is mounted to the frame 150 for selectively locating an incoming cut sheet (of the sheets 1-N), to a top of the stack 154 (FIG. 2), or to a bottom of a stack 154 (FIGS. 3A, 3B). As shown in FIGS. 2, 3A and 3B, the sheet lifting and locating assembly 156, in the form of the set of rolls 158 having a down position (FIG. 2) and an up position (FIGS. 3A, 3B), is mounted to the frame 150 and through a cutout 160 in the sheet supporting member 152, and such that the set of rolls 158 projects slightly above a top, sheet supporting, surface of the member 152.

When the desired stacking sequence, (bottom-to-top) is 1-N, where "1" is the first sheet fed into the apparatus 54, the movable set of rolls 158 is set to its down position (FIG. 2). A sheet feeding assembly such as a pair of nip rolls 162 feeds the sheets 1-N seriatim onto the sheet supporting member 152, and to a top of a stack 154. The stack 154 and each sheet so fed is stopped by an adjustable position member 164 located at the distal end of the sheet supporting member 152. The movable set of rolls 158 is located spaced from the feeding assembly or nip rolls 162 such that a lead edge 167 of a sheet (e.g., "N") (FIG. 2) when fed freely from the nip rolls 162, will contact the sheet supporting member 152 or the stack 154 at a point downstream of the set of rolls 158 relative to the direction of travel of the sheet being fed. This prevents such leading edge 167 from snubbing on that portion of the set of rolls 158 projecting slightly above the surface of the member 152. As such, sheet after sheet of the set 1-N can be fed onto the member 152, one at a time, and to the top, to form a stack (FIG. 2).

However, as shown in FIGS. 3A, 3B, when it is desirable to reverse the sequence of sheets in the stack 154 from 1-N to N-1, the pivotable sheet supporting member 152, and the movable set of rolls 158, are set to the up position (FIG. 3A). The lead edge 167 of the first sheet "1" when fed, moves beyond the set of rolls 158 on shaft 159 and lands on the member 152 as shown in FIG. 3A. Importantly, because the set of rolls 158 on shaft 159 projects through the cutout 160 and slightly above the top surface of the member 152, a trail end 168 of the sheet "1" will be supported by the set of rolls 158 on shaft 159 at a level above an entering lead edge 170 of the next sheet, sheet "2". The top of the set of rolls 158, although projecting slightly above the top surface of the member 152, preferably still has to be just below the entry level of such lead edge 170. As such, the lead edge 170 of the next sheet "2" will feed into a nip created between the first sheet "1" and the top of the set of rolls 158.

In accordance with a particular aspect of the present invention, the movable set of rolls 158 on shaft 159 may be comprised of a low coefficient of friction roll, that is friction driven in its up position and in the direction of the arrow 166, by the next feeding sheet "2" (FIG. 3A) with a feeding force from the feed nip rolls 162, or positively driven in such direction by a drive means (not shown). This process of feeding the next sheet to the bottom of the preceding sheet (and to the top of the set of rolls 158) is continued until a stack 154 consisting of such sheets in an N-1 (bottom-to-top) sequence is completely formed on the set of rolls 158, and on the supporting member 152 (FIG. 3B).

Figure 4:
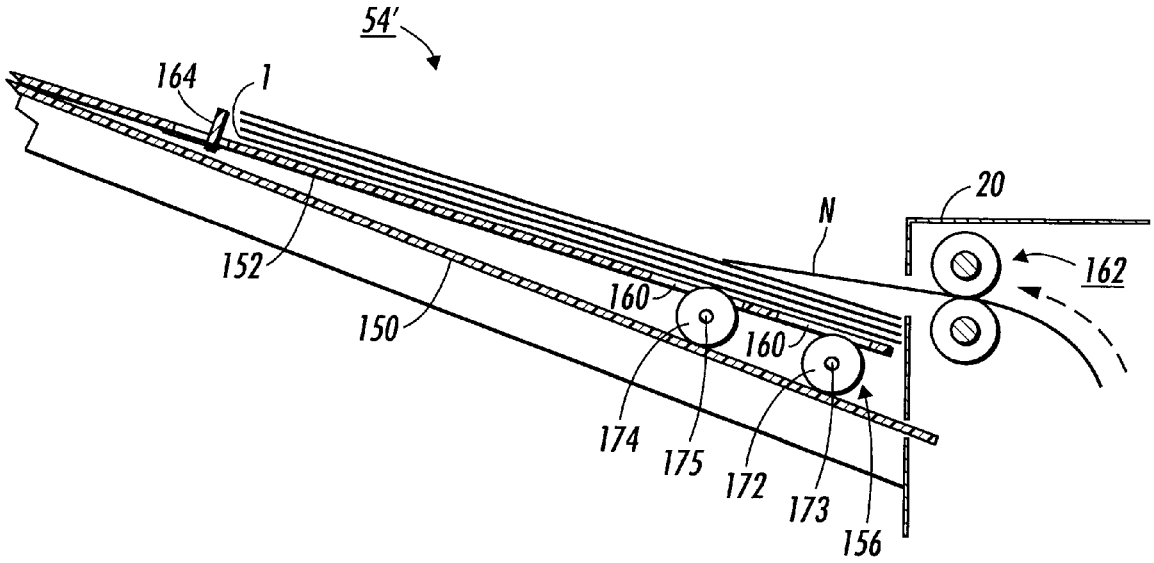
FIG. 4 is a schematic illustration of a second embodiment of the 1-N and N-1 cut sheet receiving and stacking apparatus in accordance with the present invention.

Referring now to FIGS. 4, 5A and 5B, a second embodiment of the 1-N and N-1 cut sheet receiving and stacking apparatus 54' is illustrated. As shown, this embodiment also includes a frame 150 mounted to a frame of the machine 20, and a sheet supporting member 152 mounted pivotably (pivot point not shown) to the frame 150 for supporting a stack 154 of cut sheets in a desired 1-N (bottom-to-top) sequence (FIG. 4), or in an N-1 (top-to-bottom) sequence (FIGS. 5A and 5B).

Importantly, the apparatus 54' of this second embodiment includes a cut sheet lifting and locating assembly, shown generally as 156', for example, a pair of independently movable sets of rolls 172, 174 on shafts 173, 175 respectively, that are mounted to the frame 150 for selectively locating an incoming cut sheet (of the sheets 1-N), to a top of the stack 154 (FIG. 4), or to a bottom of a stack 154 (FIGS. 5A, 5B). As shown in FIGS. 4, 5A and 5B, the sheet lifting and locating assembly 156', in the form of the sets of rolls 172, 174, each having a down position (FIG. 4) and at least an up position (FIGS. 5A, 5B), is mounted to the frame 150 and through a cutout 160 in the sheet supporting member 152, and such that the sets of rolls 172, 174 each project slightly above a top, sheet supporting, surface of the member 152.

When the desired stacking sequence, (bottom-to-top) is 1-N, where "1" is the first sheet fed into the apparatus 54', the movable sets of rolls 172, 174, are each set to its down position (FIG. 4). A sheet feeding assembly such as a pair of nip forming rolls 162 feed the sheets 1-N seriatim onto the sheet supporting member 152, and to a top of a stack 154. The stack 154 and each sheet so fed is stopped by an adjustable position member 164 located at the distal end of the sheet supporting member 152. The movable sets of rolls 172, 174 are located spaced from the feeding assembly or nip rolls 162 such that a lead edge 167 of a sheet (e.g., "N") (FIG. 4) when fed freely from the nip rolls 162, will contact the sheet supporting member 152 or the stack 154 at a point downstream of the more distal (174) of the sets of rolls 172, 174. This prevents such leading edge from snubbing on that portion of any of the sets of rolls 172, 174 projecting slightly above the top surface of the member 152. As such, sheet after sheet of the set 1-N can be fed onto the member 152, one at a time, and to the top, to form a stack 154 (FIG. 4).

However, as shown in FIGS. 5A, 5B, when it is desirable to reverse the sequence of sheets in the stack 154 from 1-N to N-1 (bottom-to-top view), the pivotable sheet supporting member 152, and the movable sets of rolls 172, 174, are each set to an up position, for example (FIGS. 5A or 5B). The lead edge 167 of the first sheet "1" when fed, moves over, and beyond the sets of rolls 172,174, and lands on the member 152 as shown in FIG. 5A. Importantly, because the sets of rolls 172, 174 each project through a cutout 160 and slightly above the top surface of the member 152, a trail end 168 of the sheet "1" can be supported by one or both of the sets of rolls 172, 174 at a level above an entering lead edge 170 of the next sheet, e.g., sheet "2". In FIG. 5A only the far side set of rolls 174 is shown supporting the trail end 168 as such. The tops of the sets of rolls 172, 174 however, each still have to be just below the entry level of such lead edge 170. As such, the lead edge 170 of the next sheet "2" will feed into a nip created between the first sheet "1" and the top of the near side set of rolls 172, and into a similar nip on the far side set of rolls 174.

In accordance with a particular aspect of the second embodiment 54' of present invention, the far side set of rolls 174, comprising a first sheet lifting and locating assembly, has a second up position (as shown in FIG. 5A) that is higher than its first up position (FIG. 5B), and in which it is higher than the near side set of rolls 172. When the far side set of rolls 174 is in such second, higher, up position, and the near side set 172 at the same is at its first, and lower, up position (FIG. 5A), the trail end 168 of the sheet "1", or of a stack 154 being supported on the set 174, will advantageously be spaced above the near side set 172, which comprises the second sheet lifting and locating assembly of the present invention. The lead edge 170 of a subsequent sheet, e.g., "N" can thus be fed freely into the space over the near side set 172. However, before such lead edge 170 reaches the far side set 174, such set 174 can momentarily be dropped towards its down position (FIG. 4), long enough to allow the feeding lead edge 170 to move over it. During such a momentary drop, the rest of the stack 154 is allowed to drop onto the feeding sheet "N" and on the near side set 172. The set 172 alone, or together with the far side set 174 reset to its first up position (which is at the same height as that of the set 172), then assists the feeding nip rolls 162 to feed the rest of the sheet "N" into its fully fed position at the bottom of the stack 154.

In the second embodiment, the first and the second lifting assemblies or sets of rolls 174, 172 respectively, each have a down position (FIG. 4) for receiving an incoming sheet to a top of a stack of cut sheets on the sheet supporting member, and at least one up position each (FIG. 5B) for receiving an incoming sheet to a bottom of the stack. The first lifting and locating assembly 174 is mounted so as to lift the stack of cut sheets off of the second lifting assembly 172, so as to allow an incoming sheet to be fed freely to a bottom of the stack, at least partially past the second lifting assembly 172. The second lifting assembly 172 may also be mounted so as to then engage and the incoming sheet fed partially thereover, and the stack, and lift or hold such stack at a point spaced above the first lifting assembly 174, and hence off of the first lifting assembly 174, so as to allow the incoming sheet to be fed with less effort over the assembly 174 and into the bottom of the stack 154. The first assembly 174 may then be reset to engage and assist in driving the incoming sheet into its fully fed bottom position under the stack 154.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

What is claimed is:

1. Apparatus for receiving and selectively stacking cut sheets, the apparatus comprising:

(a) a frame;

(b) a sheet supporting member formed on said frame for supporting a stack of cut sheets; and (c) cut sheet lifting and locating assemblies mounted to said frame for selectively locating an incoming cut sheet to a bottom location of a stack of cut sheets on said sheet supporting member, said sheet lifting and locating assemblies including:

(i) a first lifting assembly mounted to said frame for lifting the stack of cut sheets on said sheet supporting member;

(ii) a second lifting assembly, mounted to said frame and upstream of said first lifting assembly, relative to a direction of sheet travel, for also lifting the stack of cut sheets on said sheet supporting member, said second lifting assembly being mounted so as to lift the stack of cut sheets off of said first lifting assembly to allow an incoming sheet to be fed partially past said first lifting assembly, and into a bottom location of the stack; and (iii) means for feeding the incoming sheet past said second lifting assembly and said first lifting assembly, and into a bottom location of the stack of cut sheets on said sheet supporting member.

2. The sheet receiving and stacking apparatus of claim 1, wherein said first and said second lifting assemblies each have a down position for receiving an incoming sheet to a top location of a stack of cut sheets on said sheet supporting member, and at least one up position each for enabling the receiving of an incoming sheet to a bottom location of the stack.

3. The sheet receiving and stacking apparatus of claim 1, wherein said first lifting assembly is mounted to said frame so as to lift the stack of cut sheets off of said second lifting assembly to allow an incoming sheet to be fed partially past said second lifting assembly, and into a bottom location of the stack.

4. An electrostatographic reproduction machine comprising:

(a) a copy sheet input assembly for supplying copy sheets to an image transfer station;

(b) means for producing and transferring document images onto supplied copy sheets;

(c) a 1-N and N-1 copy sheet output apparatus for receiving and stacking the copy sheets, the 1-N and N-1 copy sheet output apparatus including:

(i) a frame;

(ii) a sheet supporting surface formed on said frame for supporting a stack of cut sheets; and (iii) cut sheet lifting and locating assemblies mounted to said frame for selectively locating an incoming cut sheet to a bottom location of a stack of cut sheets on said sheet supporting member, said sheet lifting and locating assemblies including:

a first lifting assembly mounted to said frame for lifting the stack of cut sheets on said sheet supporting member;

a second lifting assembly, mounted to said frame and upstream of said first lifting assembly, relative to a direction of sheet travel, for also lifting the stack of cut sheets on said sheet supporting member, said second lifting assembly being mounted so as to lift the stack of cut sheets off of said first lifting assembly to allow an incoming sheet to be fed partially past said first lifting assembly, and into a bottom location of the stack; and means for feeding the incoming sheet past said second lifting assembly and said first lifting assembly, and into a bottom location of the stack of cut sheets on said sheet supporting member.

5. The electrostatographic reproduction machine of claim 4, wherein said first and said second lifting assemblies each have a down position for receiving an incoming sheet to a top location of a stack of cut sheets on said sheet supporting member, and at least one up position each for enabling the receiving of an incoming sheet to a bottom location of the stack.

6. The electrostatographic reproduction machine of claim 4, including a controller for selectively moving said first and said second lifting assemblies each between said down position and said at least one up position.

7. The electrostatographic reproduction machine of claim 4, wherein said first lifting assembly is mounted to said frame so as to lift the stack of cut sheets off of said second lifting assembly to allow an incoming sheet to be fed partially past said second lifting assembly, and into a bottom location of the stack.

* * * * *